US006053025A

United States Patent [19]

Beetz et al.

[11] Patent Number: 6,053,025

[45] Date of Patent: Apr. 25, 2000

[54] PLIERS FOR CRIMPING WORKPIECES

[75] Inventors: Horst Beetz, Stadtallendorf; Kurt Battenfeld, Ebsdorfergrund, both of Germany

[73] Assignee: WEZAG GmbH Werkzeugfabrik, Stadtallendorf, Germany

[21] Appl. No.: 09/232,535

[22] Filed: Jan. 18, 1999

[30] Foreign Application Priority Data

Jan. 22, 1998 [DE] Germany ..... 198 02 287

[51] Int. Cl.[7] ..... H01R 43/042

[52] U.S. Cl. ..... 72/409.16; 72/413; 81/423; 29/751

[58] Field of Search ..... 72/409.16, 413, 72/481.1, 481.3, 481.7, 481.8, 482.92; 81/421–423; 29/751, 753

[56] References Cited

U.S. PATENT DOCUMENTS

| | | | |
|---|---|---|---|
| 558,673 | 4/1896 | Colling | 72/413 |
| 2,814,222 | 11/1957 | Sanders . | |
| 4,726,266 | 2/1988 | Undin | 81/416 |
| 4,829,805 | 5/1989 | Koehn | 29/751 |
| 5,063,770 | 11/1991 | Chen | 81/421 |

FOREIGN PATENT DOCUMENTS

| | | | |
|---|---|---|---|
| 37 17 130 A1 | 5/1987 | Germany . | |
| 296 19 451 U | 11/1996 | Germany . | |
| 657559 | 9/1986 | Switzerland | 72/409.16 |

OTHER PUBLICATIONS

Brochure of AMP Deutschland GmbH, "Handzangenkoffer für Fertigung und Service" 1997.

Brochure of Thomas + Betts GmbH for Crimping Tools, pp. 14–25 and 53, Nov. 1995.

*Primary Examiner*—Daniel C. Crane

*Attorney, Agent, or Firm*—Thomas, Kayden, Horstemeyer & Risley, L.L.P.

[57] ABSTRACT

Pliers (1) for crimping workpieces include a first mounting die (5) having an outline, a second mounting die (6) having an outline, a first crimping die (8) and a replaceable second crimping die (9) being mounted to the second mounting die (6). The replaceable second crimping die (9) in its mounted position has a portion (11) extending beyond the outline of the second mounting die (6) and a flange (10) not extending beyond the outline of the second mounting die (6). Bores (25) are arranged in alignment in the second mounting die (6) and in the replaceable second crimping die (9). A removable fixing screw (26) is arranged in the bores (25). At least one circumferentially closed opening (14, 15) is arranged in a region (13) between the portion (11) and the flange (10). A transverse support member (16, 17) is arranged in the circumferentially closed opening (14,15). The transverse support member (16, 17) extends beyond both sides of the flange (10). At least one circumferentially open opening (20, 21) is arranged in the second mounting die (6), the circumferentially open opening (20, 21) supporting the transverse support member (16, 17) to transmit power and to prevent shifting of the transverse support member (16, 17) with respect to the second mounting die (6). A drive (2) moves one of the mounting dies (5, 6) toward and away from the other mounting die (6, 5).

17 Claims, 4 Drawing Sheets

PLIERS FOR CRIMPING WORKPIECES

FIELD OF THE INVENTION

The present invention generally relates to pliers for crimping workpieces including two mounting dies and two crimping dies. More particularly, the present invention relates to pliers including at least one replaceable crimping die.

BACKGROUND OF THE INVENTION

Pliers for crimping workpieces are commonly known. Usually, the pliers are used to connect electrical connectors to the end of an electrical conductor. But it is also possible to use the present invention for other pliers or scissors.

It is essential to the invention that two crimping dies and two mounting dies are provided, at least one of the two crimping dies being replaceably arranged at the corresponding mounting die. The invention is especially directed to pliers in which the mounting dies and the crimping dies connected to the mounting dies are pivoted. This means that the mounting dies and the crimping dies are moved in a scissors-like movement toward and away from each other. The present invention is also applicable for pliers in which the mounting dies are linearly moved toward and away from each other.

Pliers are known from the brochure "Handzangenkoffer für Fertigung und Service" of AMP Deutschland GmbH, issue 1997. The pliers have a hand drive including two pivotable handles or levers. The handles transfer their movement to mounting dies, one crimping die being replaceably arranged at each mounting die. Each crimping die includes a support step which is allocated to a linear edge portion of the corresponding mounting die. The crimping die with its support step is supported on the linear edge portion of the mounting die. The crimping force is transferred to the crimping die by this support step. The support step has to be produced in an additional processing step. Usually, the support step is produced by a milling cutter to attain the necessary tolerances. This is true for a plate arrangement as well as for cast crimping dies. The crimping die includes a flange which in its mounted position does not extend beyond the outline of the mounting die. A freely protruding portion is connected to the flange, the portion, for example, being provided with dies or other tools. The support step is located the region between the flange and the portion. Bores are provided in alignment in the mounting die and in the flange of the crimping die to affix the crimping die to the mounting die. A fixing screw is inserted into the bores with a clearance and it is tightened. It is advantageous that the crimping die is easy to replace by unscrewing the fixing screw. Additionally, the power is transferred by a relatively large support step. Usually, the mounting die includes two parts, so that a support step is arranged on each side of the crimping die. It is disadvantageous that the support steps have to be processed by a milling cutter, or, using cast crimping dies, that the support step has to be formed in the cast form with a certain precision. The crimping die itself may include several plates having different dimensions corresponding to the depth of the die. When the crimping die is loosened or replaced, the plates fall apart, so that there is a likelihood of mixing up the plates by mistake. Especially in case of pliers using a scissors-like movement of the mounting dies, the mounting dies tend to shift from the joint connecting the mounting dies to the outside, so that the mounting die is dislocated by the support step sliding on the corresponding edge portion of the mounting die. The shifting movement is limited by the clearance of the fixing screw.

Such a shifting movement leads to a change of the crimping point, and has a negative effect on the crimping preciseness. The threat of the fixing screw is not suitable for a stop limiting the shifting movement.

It is known from the above cited brochure to prevent the shifting movement by mounting the crimping die to the mounting die using pins. Two bores are arranged in the flange of the crimping die, and the mounting die includes two corresponding bores arranged in alignment. Two pins are inserted with force into the circumferentially closed openings or bores in the mounting die and in the flange of the crimping die. The pins are mounted in the flange of the crimping die with a press fit, as well as in the mounting die. Additionally, bores are arranged in the flange of the crimping die and in the mounting die, the fixing screw being inserted into these bores with a clearance. The fixing screw is necessary to affix the elements and to pull them together. The advantage of using a pin is that the crimping die does no longer tend to shift, and that an exact relative position of the crimping die with respect to the mounting die is ensured, considering the processing tolerances. Thus, the processing quality is improved. In case it is possible using the pins, the support surface serving to transfer power is advantageously enlarged by a double fit additional to the support step. The embodiment using pins may be also used if the crimping die does not include a support step. In this case, the support surface formed by the two pins exclusively transfers the power. It is disadvantageous in these known pliers that it is rather difficult to replace the crimping die, which requires the driving out the pins after loosening the fixing screw. The processing of these pliers is comparatively complicated. A certain precision has to be attained with respect to applying the bores considering the tolerance.

Pliers are also known from the German Patent Application DE 37 17 130 A1. One crimping die is replaceably connected to each mounting die. One screw and two pins are provided extending through the aligned openings located in the corresponding mounting die and in the corresponding crimping die. In case the pins are arranged in the openings with a press fit, the shifting of the crimping dies from the joint connecting the mounting dies to the outside is prevented, so that the crimping dies cannot slide on the support step located on the corresponding edge portion of the mounting die. This arrangement does not allow a fast and simple replacement of the crimping dies.

Furthermore, cast crimping dies are known, the crimping dies including a cast support step. The mounting die and the flange of the crimping die are also connected to each other by a fixing screw extending through these elements. Additionally, two bores are arranged in the mounting dies, and one bore is arranged in the flange of the crimping die. Only one of the bores arranged in the mounting die is used by a pin being driven into the bore. This pin and the support step located at the crimping die transfer the power, so that there is no likelihood of shifting of the crimping dies. On the other hand, it is difficult to attain a coordination of the support step with respect to the driven in pin considering the tolerances. The known pliers which serve to crimp isolated electrical connectors include a mounting die having a circumferentially open semicircular recess. A semicircular protrusion arranged at the support step engages the recess with a clearance. This arrangement only prevents a mixing up of the crimping dies during insertion into the mounting dies. The semicircular recess does neither have an influence on the transfer of power, nor on the shifting. Anyway, the semicircular recess is only arranged on one of the two mounting dies.

SUMMARY OF THE INVENTION

Briefly described, the present invention provides pliers for crimping workpieces. The pliers include a first mounting die, a second mounting die, a first crimping die and a replaceable second crimping die being mounted to the second mounting die. The replaceable second crimping die in its mounted position has a portion extending beyond the outline of the second mounting die and a flange not extending beyond the outline of the second mounting die. Bores are arranged in alignment in the second mounting die and in the replaceable second crimping die. A removable fixing screw is arranged in the bores. At least one circumferentially closed opening is arranged in a region between the portion and the flange. A transverse support member is arranged in the circumferentially closed opening. The transverse support member extends beyond both sides of the flange. At least one circumferentially open opening is arranged in the second mounting die. The circumferentially open opening supports the transverse support member to transmit power and to prevent shifting of the transverse support member with respect to the second mounting die. Finally, a drive for moving one of the mounting dies toward and away from the other mounting die is provided.

With this novel design of the pliers, an undesired movement or shifting of the crimping pliers is prevented. A transverse support member extending beyond both sides of the flange of the crimping die is used. This transverse support member is no longer arranged inside the flange of the crimping die, but in a region between the freely protruding section of the crimping die and the flange of the crimping die instead. This transverse support member is arranged in the crimping die by a force or press fit, or it is formed from one piece with the crimping die. In all cases, the transverse support member is fixedly connected to the crimping die. When the crimping die has a plate design, a press fit is used. The press fit ensures that the plates of the crimping die do not fall apart during assembly or disassembly. A circumferentially open opening is arranged in the generally straight-lined edge portion of the mounting die. The shape of the circumferentially open opening corresponds to the transverse support member of the mounting die. In its mounted position, the transverse support member is supported on the circumferentially open opening. This means that the transverse support member is used to transfer power, and, at the same time, that the crimping die cannot be moved or shifted relative to the mounting die. It is not sufficient to provide one single point of power transfer to prevent turning of the crimping die relative to the mounting die. A second point of power transfer has to be provided. This second point of power transfer can be realized by the known support step, or by a fixing screw having a special design. The processing tolerances have to be met and matched. Nevertheless, the crimping die is easy to replaceable in a short period of time. For the replacement, it is only necessary to unscrew the fixing screw and to pull out the crimping die with its flange between the two elements of the mounting die. It is easily possible to prevent an undesired position of the crimping dies in the mounting dies, and to prevent mixing up of the crimping dies.

Advantageously, two transverse support members and two circumferentially open openings are included in the pliers. Such pliers include two spaced apart openings in the region between the portion and the flange. The transverse support members extending away from both sides of the flange are arranged in the opening fixedly or by a press fit. The mounting die includes two circumferentially open openings to support the protruding transverse support members of the crimping die relative to the mounting die.

It is important that the two transverse support members are spaced apart, so that the crimping die does not tend to turn relative to the mounting die, and that the desired fix position of the crimping die relative to the mounting die is attained. The fixing screw is also necessary. The fixing screw does not transmit power, but only serves to pull the elements together. The circumferentially open openings and the transverse support members are designed to be easily assembled or disassembled, after the fixing screw has been unscrewed. It is sufficient if one of the openings and one of the transverse support members provides the fix position of the crimping die relative to the mounting die, and if a corresponding power support of the transverse support members is attained in the region of the other openings. This double arrangement of the openings and of the transverse support members provides a great number of possibilities to exchange the crimping dies, for example, the possibility of changing the pliers from a right handed use to a left handed use and vice versa. It is also possible to prevent an undesired exchange of the crimping dies, in the sense of mixing them up, by allowing only one assembled position. The transverse support members may be designed to have a great enough cross section to realize the necessary transfer of power. The time consuming processing of the support step is not necessary. Nevertheless, support steps may be provided at the novel pliers. In this case, the support steps do not transfer power. It is also possible to use cast crimping dies including cast supporting steps. The novel pliers are easy and fast to assemble and to disassemble. The threat of the fixing screw is not damaged, since it is not used to transfer power. If the invention is used for both crimping dies of the pliers, it is easily possible to change the arrangement of the crimping dies from a right handed use to a left handed use and vice versa. The invention can be especially used for mounting dies which are moved in a scissors-like movement. But it is also possible to use the invention in pliers having linearly moved mounting dies. It is important that the crimping dies can be used in both systems, in a scissors-like system and in a linear system as well.

Each transverse support member may be formed as a pin having a circular cross section. Each circumferentially open opening may be semicircular. It is easy to produce circular pins, and they do not hinder the plate arrangement of the crimping die in any way. The circumferentially open openings arranged at the mounting dies may be formed in one processing step together with the punching or stamping of the outline of the mounting die. A plate arrangement is possible in an advantageous way. Such a circular design is easy to produce and to apply. Nevertheless, the invention can be also used for designs different from a circular design. For example, the transverse support member and the circumferentially open opening may have a hexagon cross section, a tetragon cross section, or any other polygon cross section. It is also possible to use cross sections different from a polygon cross section. In this case, it is more complicated to produce the transverse support members, and the circumferentially open openings. It is important that the circumferentially open opening (to transfer power and to prevent shifting of the protruding transverse support member of the crimping die relative to the mounting die) and the portion of the transverse support member extending into the circumferentially open opening have a corresponding design.

The circumferentially open opening and the transverse support member may be arranged substantially symmetric to a normal plane. The normal plane extends substantially perpendicular to an edge portion of the mounting die and through an axis of the fixing screw. This arrangement can be used to attain a simple possibility of inserting the crimping dies into the mounting dies at an angle of 180°. Additionally, it is possible to change the allocation of the crimping dies to the mounting dies. This means that each crimping die can be inserted into each mounting die.

On the other hand, it is also possible that the circumferentially open opening and the transverse support member are unequally spaced apart from the normal plane. In this case, it is also possible to exchange the crimping dies. This means, that each crimping die can be arranged at each mounting die. This embodiment ensures that the crimping dies cannot be turned about 180° as described above. This makes it possible, for example, in case of an arrangement of different dies having different cross sections, that only the die that requires the greatest crimping force corresponding to the ratio is arranged closest to the joint of the mounting dies.

Another variation between one crimping die with respect to the other crimping die is possible. For example, the circumferentially open openings and the transverse support members can be arranged at one crimping die with a distance to the normal plane different from the other crimping die.

The crimping die and the transverse support member may be cast en block. These cast pliers may also include a support step if necessary due to the depth of the die and of the crimping tool, respectively.

The fixing screw may be formed as a bush screw and it may additionally to the transverse support member transfer power. This arrangement is used if only one transverse support member and only one circumferentially open opening are arranged.

The mounting die may include two parts surrounding the flange of the crimping die. The two parts are connected to each other by the fixing screw.

It is therefore an object of the present invention to provide pliers for crimping workpieces in which the crimping dies do not tend to shift or move with respect to the mounting dies.

Another object of the present invention is to provide pliers in which the crimping dies are easily replaceable.

Another object of the present invention is to provide pliers that allow a right handed use as well as a left handed use.

Another object of the present invention is to provide pliers that allow a simple change from a right handed use to a left handed use.

Another object of the present invention is to provide pliers that prevent an incorrect assembly of the crimping dies into the mounting dies.

Still another object of the present invention is to prevent damage of the fixing screw.

Other objects, features and advantages of the present invention will become apparent to one with skill in the art upon examination of the following drawings and the detailed description. It is intended that all such additional objects, features and advantages be included herein within the scope of the present invention, as defined by the claims.

DETAILED DESCRIPTION

Figure 1:
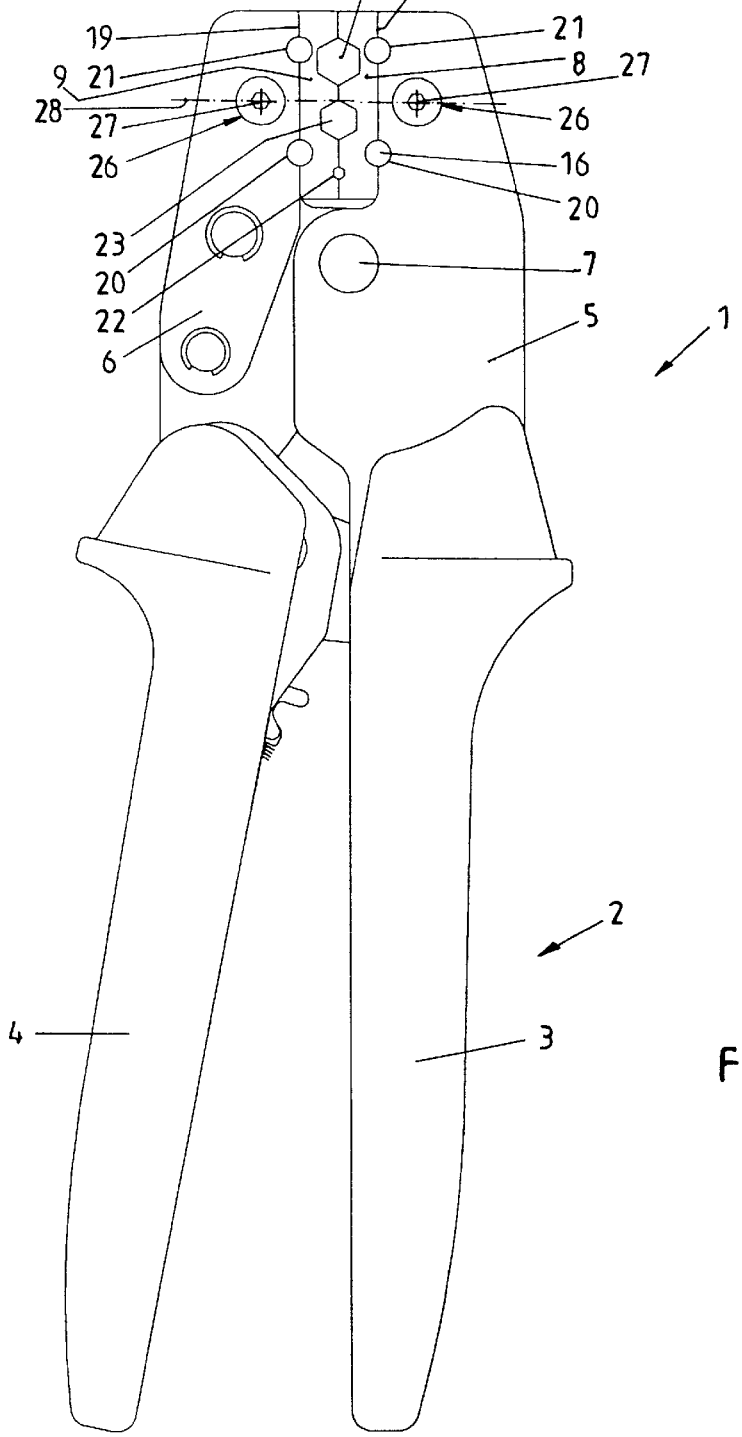
FIG. 1 illustrates a first embodiment of the pliers for crimping workpieces including the mounted crimping dies in their closing position.

Referring now in greater detail to the drawings, FIG. 1 illustrates pliers 1 for crimping workpieces with their essential parts. The pliers 1 include a drive 2 in form a handle 3 and a handle 4. The drive 2 could be also realized electrically, pneumatically or hydraulically.

The handle 3 is connected to a mounting die 5. The handle 3 and the mounting die 5 are one-piece. The handle 4 is operatively connected to a mounting die 6 which can be moved with respect to the mounting die 5 in a scissors-like movement. The mounting dies 5 and 6 are operatively connected by a common joint 7. A crimping die 8 is replaceably connected to the mounting die 5. A crimping die 9 is replaceably connected to the mounting die 6. The mounting dies 8 and 9 may include one or several plates.

Figure 2:
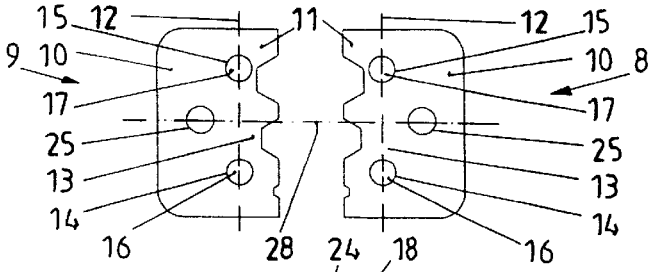
FIG. 2 illustrates a top view of the crimping dies of the pliers according to FIG. 1.

FIG. 2 illustrates a top view of the crimping dies 8 and 9. Each crimping die 8 and 9 includes a flange 10 and a portion 11. The region between the flange 10 and the portion 11 is illustrated by a dashed line. The dashed line 12 also marks the region 13. Each crimping die 8, 9 includes a first opening 14 and a second opening 15 in the region 13. In this embodiment, the openings 14 and 15 are designed as circular bores. A transverse support member 16 in the form of a pin is arranged in the opening 14 by a force or press fit. The transverse support member extends beyond the major surfaces of the crimping dies 8 and 9. Similarly, a transverse support member 17 is located in the opening 15. The transverse support member 16 and 17 are formed as pins and they have a circular cross section. They may also have any other polygonal cross section, or, for example, a rectangular or triangular shape. The shape of the openings 14 and 15 has to correspond to the shape of the transverse support members 16 and 17.

As illustrated in FIG. 1, the crimping die 5 of the mounting die 8 has a straight-lined edge portion 18. Correspondingly, the mounting die 6 has an edge portion 19. The edge portions 18 and 19 include semicircular circumferentially open openings 20 and 21 which are allocated to their transverse support members 16 and 17. The protruding ends of the transverse support members 16 and 17, respectively, are supported on both sides of the pliers. Usually, the mounting dies 5 and 6 form a U-shaped channel including two parallel and spaced apart walls between which the flanges 10 of the crimping dies 8 and 9 are supported. The semicircular shape of their openings 20 and 21 corresponds to the shape of the transverse support members 16 and 17. In this embodiment, different dies 22, 23, 24 are arranged in the region of the portions 11 of the crimping dies 8 and 9 on the sides of the crimping dies 8 and 9 facing each other. The dies 22, 23, 24 have cross sections of different dimensions. The die 22 has the smallest distance to the joint 7, and therefore provides the greatest crimping force.

It can be seen from FIG. 2 that each crimping die 8 and 9 includes a circumferentially closed opening 25 in the region of their flange 10. The mounting dies 5 and 6 include bores (not shown) being arranged in alignment to the bore 25. At this point, a fixing screw 26 with its axis 27 is provided. The fixing screw 26 extends through the bores 25 and through the bores located in the mounting dies 5 and 6 with clearance, so that the fixing screw 26 is not used to transmit power or force during the crimping action. The fixing screw 26 exclusively has the task to draw the two parts of the mounting dies 5 and 6, respectively, and the enclosed flanges of the crimping dies 8 and 9 together. The exact relative position of the crimping dies 8 and 9 with respect to the corresponding mounting dies 5 and 6 as well as their relative position with respect to each other is exclusively determined by the transverse support members 16 and 17 and by the circumferentially open openings 20 and 21.

A normal plane 28 illustrated by a dash-dot line results from the connection of both axis 27 of the fixing screws 26. The normal plane 28 extends perpendicularly to the edge portions 18 and 19. The openings 14 and 15 are arranged symmetrically to the normal plane 28 through the axis 27 of the fixing screws 26. The transverse support members 16 and 17 have the same distance to the normal plane 28. Thus, it is possible to insert the crimping dies 8 and 9 into the mounting dies 5 and 6 turned by an angle of 180° with respect to an axis extending perpendicularly to the plane of projection. Consequently, the die 24 has the smallest distance to the joint 7. The pliers 1 can be adjusted in the described manner if the die 24 is to be exclusively used, and if especially great crimping forces have to be applied. It is also possible to turn the crimping dies 8 and 9 about an axis located in the plane of projection of FIGS. 1 and 2 perpendicularly to the normal plane 28 by an angle of 180°, so that the use of the pliers 1 can be changed from right handed use to left handed use and vice versa.

Figure 4:
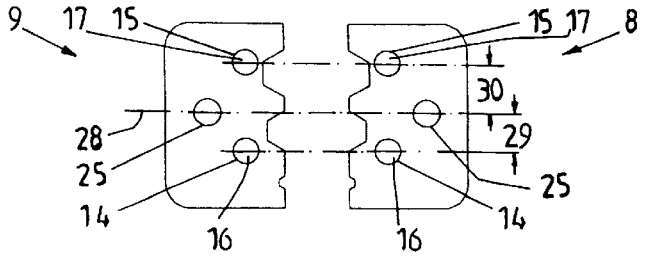
FIG. 4 illustrates the crimping dies of the pliers according to FIG. 3.
Figure 3:
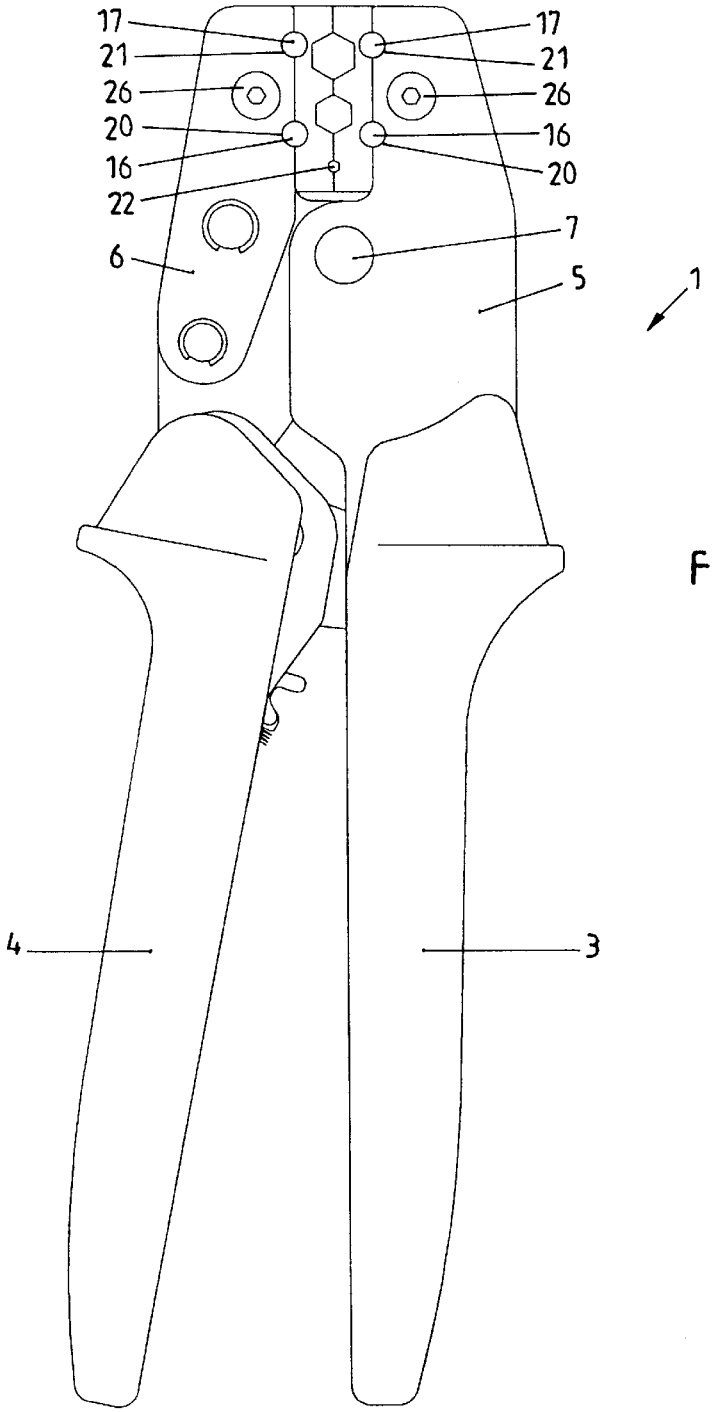
FIG. 3 illustrates a second embodiment of the pliers including the mounted crimping dies in their closing position.

FIGS. 3 and 4 illustrate another embodiment of the pliers 1. The major components of the pliers have not been changed compared to FIGS. 1 and 2. The crimping dies 8 and 9 have a slightly different design. With respect to the unchanged features, it is referred to the description of FIGS. 1 and 2. As illustrated in FIG. 4, the openings 14 have a smaller distance to the normal plane 28 than the openings 15. Consequently, the crimping dies 8 and 9 located at the mounting dies 5 and 6 have a defined mounting position with respect to the distances of the dies 22, 23, 24 to the common joint 7. Nevertheless, it is still possible to change from a right handed use to a left handed use and vice versa.

Figure 6:
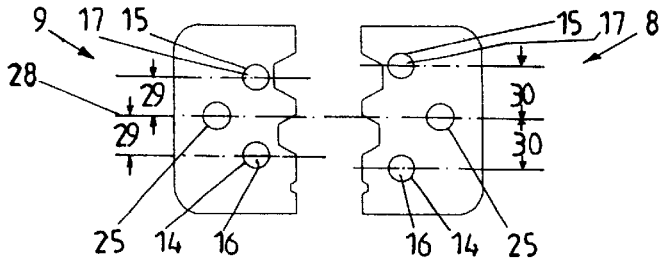
FIG. 6 illustrates a top view of the crimping dies of the pliers according to FIG. 5.
Figure 5:
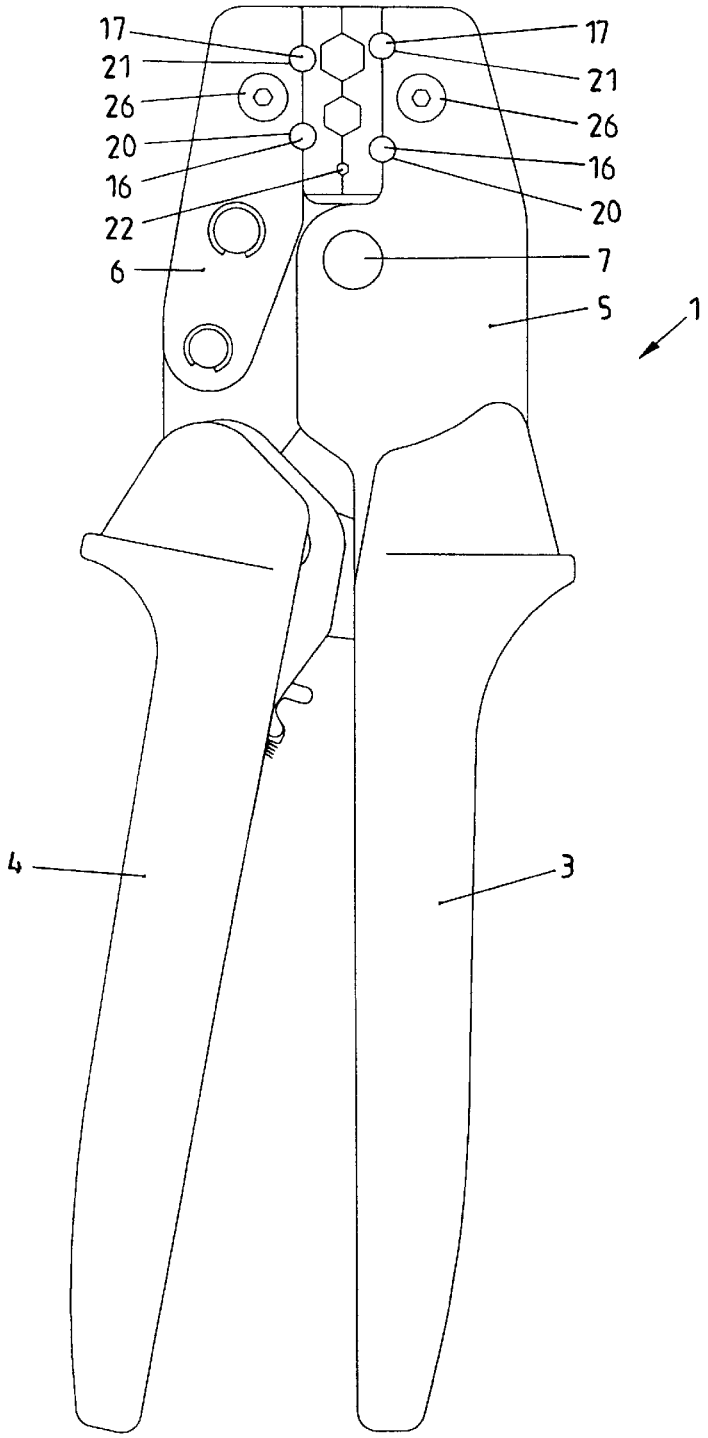
FIG. 5 illustrates a third embodiment of the pliers including the mounted crimping dies in their closing position.

FIGS. 5 and 6 illustrate another embodiment of the pliers 1. The arrangement of the openings 14 and 15 and of the transverse support members 16 and 17 at each single crimping die 8 and 9 is the same as generally described with respect to FIGS. 1 and 2. Nevertheless, the crimping die 8 is designed different from the crimping die 9. At the crimping die 8, the transverse support members 16 and 17 are arranged symmetrically to the normal plane 28 with a distance 30 to the plane 28. At the crimping die 9, the transverse support members 16 and 17 are also arranged symmetrically to the normal plane 28, but with a distance 29 which is less than the distance 30. Circumferentially open openings 20 and 21 are provided at the mounting dies 5 and 6 corresponding to the distances 29 and 30. The illustrated pliers cannot be changed from a right handed use to a left handed use. The crimping dies 8 and 9 can be turned, so that the distance of the dies 22, 23, 24 to the common joint 7 is exchanged. In one position, the die 22 is arranged below the dies 23 and 24 (FIG. 5). In the other position, the die 22 is arranged above the dies 23 and 24.

Figure 8:
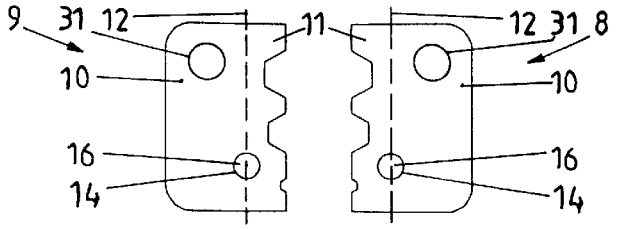
FIG. 8 illustrates a top view of the crimping dies of the pliers according to FIG. 7.
Figure 7:
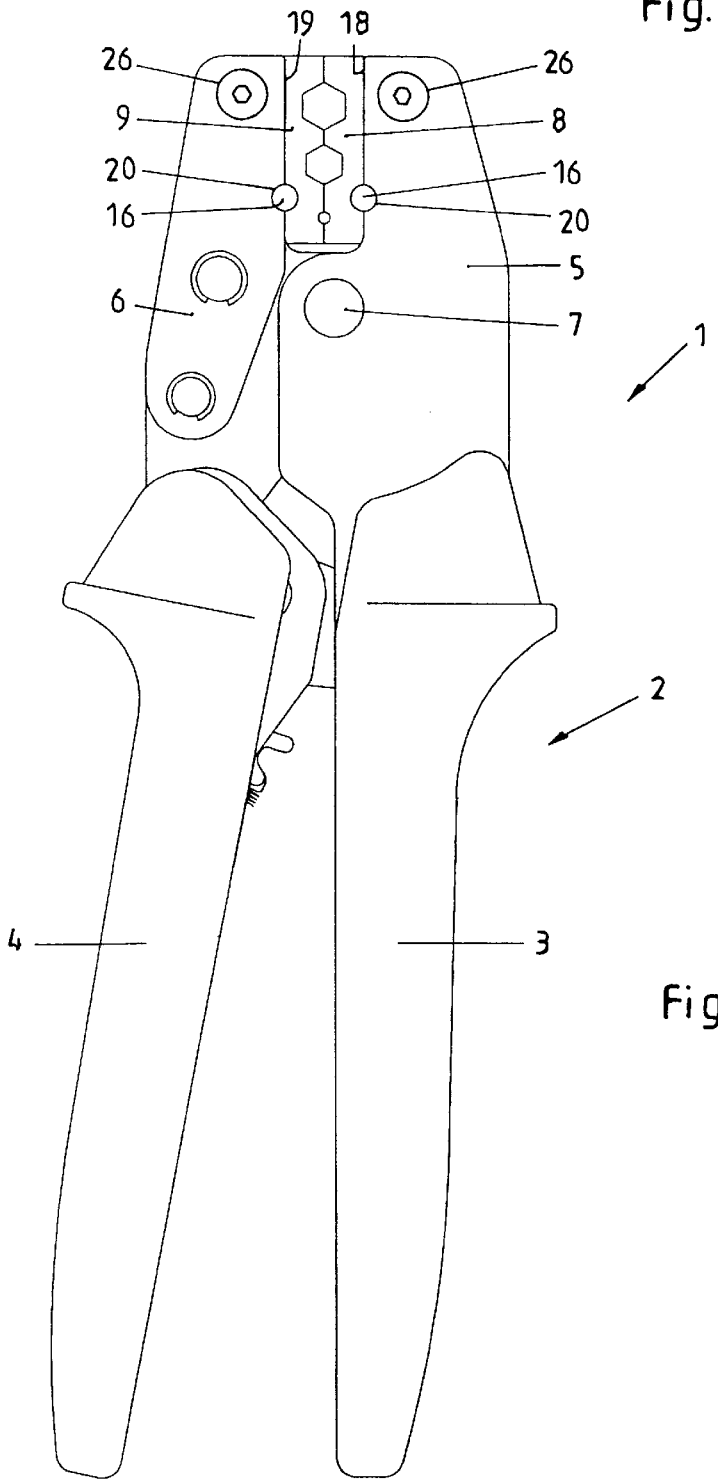
FIG. 7 illustrates another embodiment of the pliers including the mounted crimping dies in their closing position.

FIGS. 7 and 8 illustrate another embodiment of the pliers 1. In this embodiment, each crimping die 8 and 9 includes only one transverse support member 16 which is arranged in the opening 14. Consequently, the mounting dies 5 and 6 each also include only one semicircular circumferentially open opening 20. When the pliers 1 are closed, the force is transmitted by the transverse support member 16 and by the fixing screw 26. The fixing screws 26 are formed as bush screws. This means, that the fixing screws 26 include two elements which are connected to each other by a threat. The bush screws have a relatively great diameter, so that the bore 31 also has a relatively great diameter. The fixing screw 26 also serves to transfer power. Thus, at the same time, a pivoting motion of the crimping dies 8 and 9 relative to the mounting dies 5 and 6 is prevented. The clearance necessary to unscrew the fixing screw 26 can be comparatively small. Another possibility to realize a second element to transfer power is to arrange a support step at the crimping dies 8 and 9 which is supported on the edge portions 18 and 19. In this case, the clearance of the fixing screw 26 is not important.

Many variations and modifications may be made to the preferred embodiments of the invention without departing substantially from the spirit and principles of the invention. All such modifications and variations are intended to be included herein within the scope of the present invention, as defined by the following claims.

We claim:

1. Pliers for crimping workpieces comprising:

a first mounting die having an outline;

a second mounting die having an outline;

a first crimping die;

a replaceable second crimping die being mounted to said second mounting die; said replaceable second mounting die and a flange not extending beyond said outline of said second mounting die;

bores being arranged in alignment in said second mounting die and in said replaceable second crimping die;

a removable fixing screw to be arranged in said bores;

at least one circumferentially closed opening being arranged in a region between said portion and said flange;

a transverse support member being designed to be arranged in said circumferentially closed opening; said transverse support member extending beyond both sides of said flange;

at least one circumferentially open opening being arranged in said second mounting die, said circumferentially open opening supporting said transverse support member to transmit power and to prevent shifting of said transverse support member with respect to said second mounting die; and a drive adapted and arranged for moving one of said mounting dies toward and away from the other mounting die.

2. The pliers of claim 1, further comprising:

a second circumferentially closed opening being arranged in a region between said portion and said flange of said second crimping die;

a second transverse support member to be arranged in said second circumferentially closed opening; said transverse support member extending beyond both sides of said flange; and a second circumferentially open opening being arranged in said second mounting die, said second circumferentially open opening supporting said second transverse support member with respect to said second mounting die.

3. The pliers of claim 1, wherein said transverse support member is formed as a pin having a circular cross section.

4. The pliers of claim 1, wherein said circumferentially open opening is semicircular.

5. The pliers of claim 1, wherein said circumferentially open opening supporting said transverse support member to transmit power and to prevent shifting of said transverse support member with respect to said second mounting die and a portion of said transverse support member extending into said circumferentially open opening are both designed to have a corresponding polygonal shape.

6. The pliers of claim 2, wherein said first and second circumferentially open openings and said first and second transverse support members being arranged in said second mounting die are arranged substantially symmetric to a normal plane, said normal plane extending substantially perpendicular to an edge point of said second mounting die and through an axis of said fixing screw.

7. The pliers of claim 2, wherein said first and second circumferentially open openings and said first and second transverse support members being arranged in said second mounting die are unequally spaced apart from a normal plane, said normal plane extending substantially perpendicular to an edge portion of said second mounting die and through an axis of said fixing screw.

8. The pliers of claim 6, wherein said first crimping die is replaceable, and it is mounted to said first mounting die, said replaceable first crimping die in its mounted position having a first portion extending beyond said outline of said first mounting die and a first flange not extending beyond said outline of said first mounting die;

first bores are arranged in alignment in said first mounting die and in said replaceable first crimping die;

a first removable fixing screw is to be arranged in said first bores;

two spaced apart first circumferentaily closed openings are arranged in a region between said first portion and said first flange of said first crimping die;

two first transverse support members are each to be arranged in one of said first circumferentially closed openings, said first transverse support member each extending beyond both sides of said first flange;

two spaced apart first circumferentially open openings are arranged in said first mounting die, said first circumferentially open openings each supporting one of said first transverse support members to transmit power and to prevent shifting of said first transverse support members with respect to said first mounting die; and said first circumferentially open openings and said first transverse support members being arranged in said first mounting die are spaced apart from said normal plane with a different distance than said circumferentially open openings and said transverse support members being arranged in said second mounting die.

9. The pliers of claim 7, wherein said first crimping die is replaceable, and it is mounted to said first mounting die, said replaceable first crimping die in its mounted position having a first portion extending beyond said outline of said first mounting die and a first flange not extending beyond said outline of said first mounting die;

first bores are arranged in alignment in said first mounting die and in said replaceable first crimping die;

a first removable fixing screw is to be arranged in said first bores;

two spaced apart first circumferentially closed openings are arranged in a region between said first portion and said first flange of said first crimping die;

two first transverse support members are each to be arranged in one of said first circumferentially closed openings, said first transverse support members each extending beyond both sides of said first flange;

two spaced apart first circumferentially open openings are arranged in said first mounting die, said first circumferentially open openings each supporting one of said first transverse support members to transmit power and to prevent shifting of said first transverse support members with respect to said first mounting die, and said first circumferentially open openings and said first transverse support members being arranged in said first mounting die are spaced apart from said normal plane with a different distance than said circumferentially open openings and said transverse support members being arranged in said second mounting die.

10. The pliers of claim 1, wherein said second crimping die and said transverse support member are cast en block.

11. The pliers of claim 1, wherein said fixing screw is formed as a bush screw and additionally to said transverse support member transfers power.

12. The pliers of claim 1, wherein said second mounting die includes two parts surrounding said flange of said second crimping die, and wherein said two parts are connected to each other by said fixing screw.

13. The pliers of claim 1, wherein said transverse support member is designed and arranged to be fixedly connected to said circumferentially closed opening.

14. The pliers of claim 1, wherein said transverse support member is designed to be arranged in said circumferentially closed opening by a press fit.

15. The pliers of claim 1, wherein said drive for moving one of said mounting dies toward and away from the other mounting die provides a scissors-like movement of said mounting dies.

16. Pliers for crimping workpieces comprising:

a first mounting die having an outline;

a second mounting die having an outline;

a replaceable first crimping die being mounted to said first mounting die; said replaceable first crimping die in its mounted position having a first portion extending beyond said outline of said mounting die and a first flange not extending beyond said outline of said first mounting die;

a replaceable second crimping die being mounted to said second mounting die; said replaceable second crimping die in its mounted position having a second portion extending beyond said outline of said second mounting die and a second flange not extending beyond said outline of said second mounting die;

first bores being arranged in alignment in said first mounting die and in said replaceable first crimping die;

second bores being arranged in alignment in said second mounting die and in said replaceable second crimping die;

a first removable fixing screw to be arranged in said first bores;

a second removable fixing screw to be arranged in said second bores;

at least one first circumferentially closed opening being arranged in a region between said first portion and said first flange of said first crimping die;

at least one second circumferentially closed opening being arranged in a region between said second portion and said second flange of said crimping die;

a first transverse support member to be arranged in said first circumferentially closed opening; said first transverse support member extending beyond both sides of said first flange;

a second transverse support member to be arranged in said second circumferentially closed opening; said second transverse support member extending beyond both sides of said second flange;

at least one first circumferentially open opening being arranged in said first mounting die, said first circumferentially open opening supporting said first transverse support member to transmit power and to prevent shifting of said first transverse support member with respect to said first mounting die;

at least one second circumferentially open opening being arranged in said second mounting die, said second circumferentially open opening supporting said second transverse support member to transmit power and to prevent shifting of said second transverse support member with respect to said second mounting die; and a drive adapted and arranged for moving one of said mounting dies toward and away from the other mounting die.

17. Pliers for crimping workpieces comprising:

a first mounting die having an outline;

a second mounting die having an outline;

a replaceable first crimping die being mounted to said first mounting die; said replaceable first crimping die in its mounted position having a first portion extending beyond said outline of said first mounting die and a first flange not extending beyond said outline of said first mounting die;

a replaceable second crimping die being mounted to said second mounting die; said replaceable second crimping die in its mounted position having a second portion extending beyond said outline of said second mounting die and a second flange not extending beyond said outline of said second mounting die;

first bores being arranged in alignment in said first mounting die and in said replaceable first crimping die;

second bores being arranged in alignment in said second mounting die and in said replaceable second crimping die;

a first removable fixing screw to be arranged in said first bores;

a second removable fixing screw to be arranged in said second bores;

two spaced apart first circumferentially closed openings being arranged in a region between said second portion and said second flange of said second crimping die;

two transverse support members each to be arranged in one of said first circumferentially closed openings; said first transverse support members each extending beyond both sides of said first flange; two second transverse support members each to be arranged in one of said second circumferentially closed openings; said second transverse support members each extending beyond both sides of said second flange;

two spaced apart first circumferentially open openings being arranged in said first mounting die; said first circumferentially open openings each supporting one of said first transverse support members to transmit power and to prevent shifting of said first transverse support members with respect to said first mounting die;

two spaced apart second circumferentially open openings being arranged in said second mounting die, said second circumferentially open openings supporting said second transverse support members to transmit power and to prevent shifting of said transverse support members with respect to said second mounting die; and a drive adapted and arranged for moving one of said mounting dies toward and away from the other mounting die.

* * * * *